US010683597B2

(12) United States Patent
Chen et al.

(10) Patent No.: US 10,683,597 B2
(45) Date of Patent: Jun. 16, 2020

(54) WASHING MACHINE

(71) Applicant: QINGDAO HAIER DRUM WASHING MACHINE CO., LTD., Qingdao, Shandong (CN)

(72) Inventors: Yongchao Chen, Qingdao (CN); Kai Zhu, Qingdao (CN); Yanli Wang, Qingdao (CN); Yunfeng He, Qingdao (CN); Teng Chen, Qingdao (CN)

(73) Assignee: Qingdao Haier Drum Washing Machine Co., LTD., Qingdao, Shandong (CN)

( * ) Notice: Subject to any disclaimer, the term of this patent is extended or adjusted under 35 U.S.C. 154(b) by 278 days.

(21) Appl. No.: 15/570,284

(22) PCT Filed: Apr. 29, 2016

(86) PCT No.: PCT/CN2016/080747

§ 371 (c)(1),
(2) Date: Oct. 27, 2017

(87) PCT Pub. No.: WO2016/173552

PCT Pub. Date: Nov. 3, 2016

(65) Prior Publication Data

US 2018/0127911 A1 May 10, 2018

(30) Foreign Application Priority Data

Apr. 30, 2015 (CN) ..... 2015 1 0217712

(51) Int. Cl.
*D06F 39/00* (2020.01)
*D06F 34/28* (2020.01)
(Continued)

(52) U.S. Cl.
CPC ..... *D06F 34/28* (2020.02); *D06F 39/00* (2013.01); *D06F 39/14* (2013.01); *D06F 33/00* (2013.01);
(Continued)

(58) Field of Classification Search
None
See application file for complete search history.

(56) References Cited

U.S. PATENT DOCUMENTS 3,883,201 A * 5/1975 Busoni ..... D06F 37/28 49/167
2012/0036900 A1 2/2012 Hong et al.
(Continued)

FOREIGN PATENT DOCUMENTS

CN 101525833 9/2009
CN 203113095 8/2013
(Continued)

OTHER PUBLICATIONS

Extended European Search Report, European Patent Application 16785980.0, dated Oct. 5, 2018.
(Continued)

*Primary Examiner* — Cristi J Tate-Sims
(74) *Attorney, Agent, or Firm* — Greenberg Traurig

(57) ABSTRACT

A washing machine includes a breathing light group, a door body, a door hinge, a housing and a computer program controller. The breathing light group is arranged on the door body, and includes a plurality of breathing lights. The computer program controller is configured to change a quantity ratio of bright breathing lights to dimmed breathing lights among the breathing lights in the breathing light group according to a change of a working progress of the washing machine. The door body is connected to the housing via the door hinge. The door hinge has a passage through which a wire harness of the breathing light group penetrates. The wire harness penetrates through the housing through the passage and is connected to the computer program controller.

13 Claims, 13 Drawing Sheets

(51) Int. Cl.
*D06F 39/14* (2006.01)
*D06F 33/00* (2020.01)

(52) U.S. Cl.
CPC ..... *D06F 2202/12* (2013.01); *D06F 2204/10* (2013.01); *D06F 2216/00* (2013.01)

(56) References Cited

U.S. PATENT DOCUMENTS

| | | | | |
|---|---|---|---|---|
| 2012/0096734 | A1* | 4/2012 | Moon | D06F 58/10 34/218 |
| 2015/0176832 | A1 | 6/2015 | Metz et al. | |
| 2017/0121897 | A1* | 5/2017 | Kwon | D06F 39/005 |

FOREIGN PATENT DOCUMENTS

| | | | | |
|---|---|---|---|---|
| CN | 104471140 | | 3/2015 | |
| CN | 204298638 | | 4/2015 | |
| DE | 3837202 | | 5/1990 | |
| EP | 1568816 | | 8/2005 | |
| EP | 1568816 | A2 * | 8/2005 | D06F 39/005 |
| JP | 09024194 | | 1/1997 | |
| JP | 11244575 | | 9/1999 | |
| KR | 20140141099 | | 12/2014 | |
| KR | 20150006264 | | 1/2015 | |
| WO | 2002014593 | | 2/2002 | |
| WO | 2014104775 | | 7/2014 | |
| WO | 2015021725 | | 2/2015 | |

OTHER PUBLICATIONS

International Patent Application No. PCT/CN2016/080747, International Search Report, dated Jul. 6, 2016.

* cited by examiner

WASHING MACHINE

The present application is a national phase application under 35 U.S.C. § 371 of International Patent Application PCT/CN2016/080747 filed on Apr. 29, 2016, entitled "Washing Machine", which claims priority to Chinese Patent Application No. 201510217712.3, filed on Apr. 30, 2015, the entire disclosures of which applications are hereby incorporated herein by reference.

TECHNICAL FIELD

The present application relates to the technical field of laundry equipments, and for example, relates to a washing machine.

BACKGROUND

In the related art, an operating state of a washing machine is generally displayed by a combination of indicator lights, texts, numbers and the like. As shown in FIG. 1, an entire outer wall of a drum washing machine is composed of four major parts including a housing 11, a door body 12, an upper cover plate 13 and a control panel 14. A front end of the housing 11 is a front plate 111. The door body 12 is provided on the front plate 111 of the housing 11. The upper cover plate 13 is arranged at an upper end of the housing 11. The control panel 14 is arranged at the front end of the housing 11 and is located at an upper end of the front plate 111.

The control panel 14 is configured to perform operations such as washing procedure selection and operating state displaying. The control panel 14 is provided with a function selection knob 141, a power button 142, a remaining time display region 143 and an operating state display region 144 for realizing different functions respectively. The operating state display region 144 is generally composed of indicator lights 1441 and a text description sub-region 1442. When the washing machine is operated in a certain state (e.g., rinsing), the indicator light beside texts for describing the state is lighted up to inform a user of a current operation state of the washing machine. In addition, although a remaining time display region is provided in the washing machine in the related art, the remaining time display region usually shows a remaining time to the user merely via numbers.

The above display modes are not ideal in display effect. For example, when the user is too far away from the washing machine, since a font of the text description corresponding to the indicator light is too small, the user cannot clearly see which group of indicator lights in the operating state display region are lighted up, and cannot clearly see the text descriptions beside the indicator lights. Similarly, the user cannot clearly see numbers in the remaining time display region 143. At this moment, the user fails to know the current operation state of the washing machine, and cannot make appropriate measures in time, so the above display modes are very inconvenient.

Next, the washing machine in the related art is intuitive in the display effect of the operating state and the remaining time, while it is rigid and stiff in rhythm, short of flexibility and visual impact, not vivid and natural, and hard to be integrated into a concept of intelligence of products.

In addition, as for an electrical device requiring power supplying arranged on the door body, a wire harness thereof needs to be connected to a power supply inside the washing machine, so that the wire harness is exposed outside. Accordingly, an aesthetic property is affected on one hand, and the wire harness is easily damaged due to frequently opening and closing of the door on the other hand, thereby further affecting normal use of the electrical device.

Based on the above description, it is desiderated to provide a washing machine which displays the operation state and the remaining time in a new manner, so as to solve the following problems in the related art: when the user is too far away from the washing machine, the user fails to see which group of indicator lights and text description in the operating state display region are lighted up clearly, fails to see conditions of the numbers in the remaining time display region clearly and further to know the current operation state of the washing machine; and the wire harness is exposed outside to affect the aesthetic property and is easily damaged.

SUMMARY

The present application proposes a washing machine that enables a user to master the current operation state of the washing machine even if the user is relatively far away from the washing machine and facilitates the use. Moreover, the wire harness is hidden, has a nice appearance and is not easy to be damaged.

The present application adopts embodiments described below.

A washing machine includes a breathing light group, a door body (22), a door hinge (26), a housing (21) and a computer program controller. The breathing light group is arranged on the door body, and includes a plurality of breathing lights. The computer program controller is configured to change a quantity ratio of bright breathing lights to dimmed breathing lights among the plurality of breathing lights in the breathing light group according to a change of a working progress of the washing machine.

The door body is connected to the housing via the door hinge. The door hinge has a passage through which a wire harness of the breathing light group penetrates. The wire harness penetrates through the housing via the passage and is connected to the computer program controller of the washing machine.

Optionally, the door hinge includes a hinge base, a supporting cantilever arranged on the hinge base and a rotating shaft arranged on a free end of the supporting cantilever.

The passage is arranged on the supporting cantilever and penetrates through the hinge base.

Optionally, the passage includes a groove formed in at least one side face of the supporting cantilever and a through hole formed in the hinge base. The groove is extended from a free end of the supporting cantilever to the hinge base, and is communicated with the through hole.

Optionally, a wire harness fixing structure is arranged in the groove.

Optionally, the wire harness fixing structure includes a plurality of ribs arranged on two opposite side walls of the groove in a protruding manner.

Optionally, the plurality of ribs are arranged in a staggered manner.

Optionally, a sealing cover is detachably arranged at a notch of the groove to close the notch of the groove.

Optionally, the wire harness is fixed to an inner wall of the groove by metal adhesive.

Optionally, a light guide body is arranged between two adjacent breathing lights.

Optionally, the door body includes an outer frame, a middle frame and a glass window. An outer edge of the glass window is arranged between the outer frame and the middle frame to fix the glass window. An outer annular surface, a middle annular surface, an annular groove and a mounting portion for fixing the glass window are sequentially arranged on the middle frame from an outer periphery to a center position. The middle annular surface is arranged obliquely relative to the outer annular surface, and one side of the middle annular surface close to the annular groove is inclined towards the outer frame.

The breathing lights are arranged on a side wall of the annular groove close to the middle annular surface.

Optionally, the middle annular surface is an arc surface protruded inward.

Optionally, the change of the working progress is a change of a ratio of the time during which a selected procedure has been operated or a remaining time of the selected procedure to a total operation time of the selected procedure.

Optionally, the breathing light group is further arranged on a perimeter of an internal side of the door body, a control panel and/or a front plate of the housing in the washing machine.

Optionally, the breathing lights in the breathing light group are arranged in a shape of a strip, a ring, a sector, a rectangle, an oval or a circle.

Optionally, the computer program controller is configured to change the quantity ratio of bright breathing lights to dimmed breathing lights in the breathing light group, to distinctively display different working procedures of the washing machine. A method for controlling any of the above washing machines includes:

changing, by the computer program controller, the quantity ratio of bright breathing lights to dimmed breathing lights in the breathing light group, to distinctively display different working procedures of the washing machine.

The washing machine provided by the present application includes the breathing light group, the door body (22), the door hinge (26), the housing (21) and the computer program controller. The breathing light group is arranged on the door body. The breathing light group includes a plurality of breathing lights. The computer program controller is configured to change the quantity ratio of bright breathing lights to dimmed breathing lights among the plurality of breathing lights in the breathing light group according to the change of the working progress of the washing machine. Bright and dimmed states of the breathing lights are easily observed. In addition, the door hinge has the passage through which a wire harness of the breathing light group penetrates, so that the wire harness can be hidden in the door hinge. On one hand, the wire harness is effectively fixed and protected. On the other hand, the user will not see the wire harness from outside, so that the washing machine has a nice appearance.

BRIEF DESCRIPTION OF DRAWINGS

Drawings to be used in description of embodiments of the present disclosure will be briefly introduced below. The drawings in the description are just some embodiments of the present application. Those ordinary skilled in the art can also acquire other drawings according to contents of embodiments of the present disclosure without contributing creative work.

LIST OF REFERENCE NUMERALS

Figure 1:
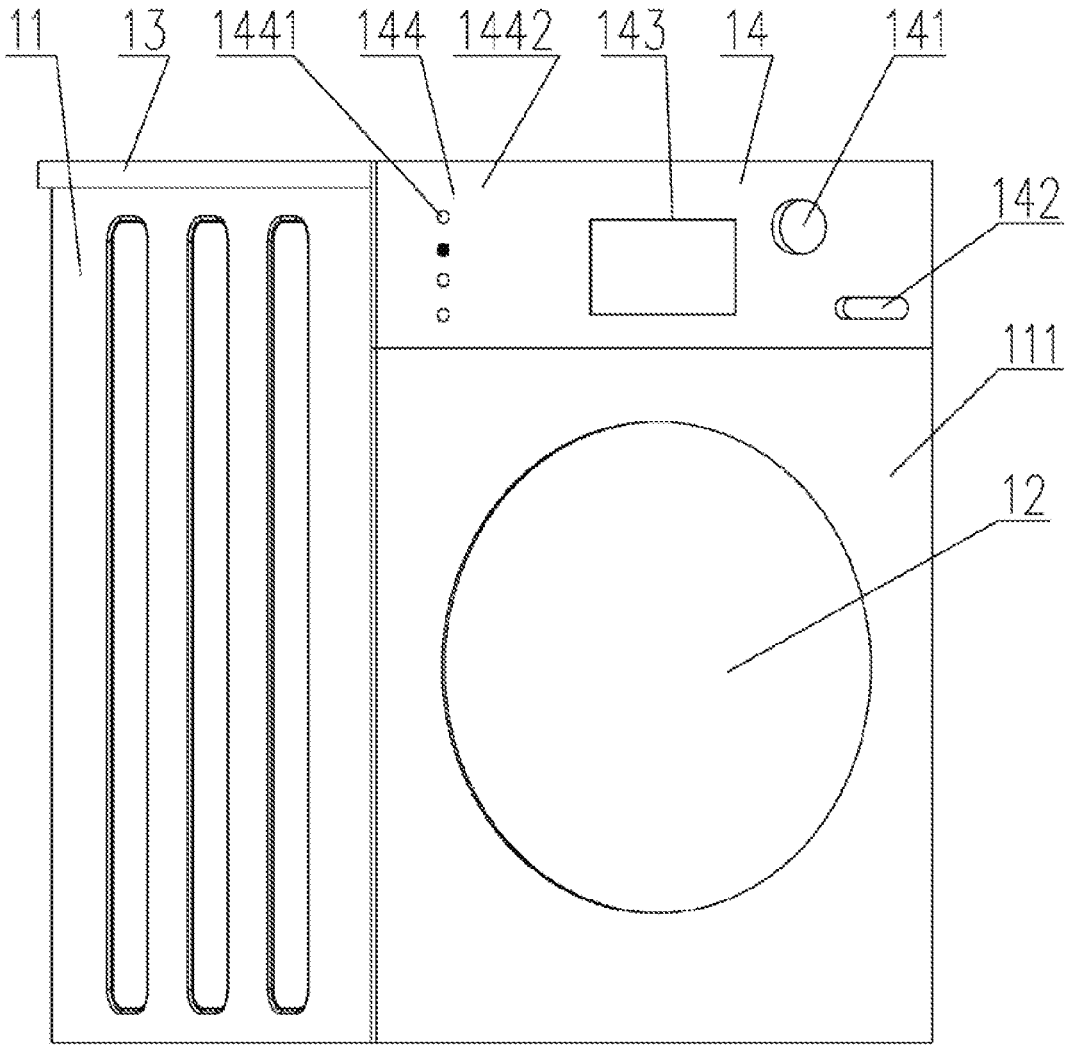
FIG. 1 is a schematic diagram illustrating an external structure of a washing machine provided by the related art.

11 housing; 12 door body; 13 upper cover plate; 14 control panel;
111 front plate;
141 function selection knob; 142 power button; 143 remaining time display region; 144 operating state display region;
1441 indicator light; 1442 text description sub-region;
21 housing; 22 door body; 23 upper cover plate; 24 control panel; 25 breathing light;
26 door hinge;
211 front plate;
222 middle frame;
2221 outer annular surface; 2222 middle annular surface; 2223, annular groove; 2224 mounting portion;
241 function selection knob; 242 power button; 243 remaining time display region; 244 operating state display region;
2441 indicator light; 2442 text description sub-region;
251 dark region; 252 lighted region;
261 hinge base; 262 supporting cantilever; 263 rotating shaft; 264 groove; 265 rib;
31 housing; 32 door body; 34 control panel; 35 breathing light;
311 front plate;
41 housing; 42 door body; 44 control panel; 45 breathing light;
411 front plate;
51 housing; 52 door body; 54 control panel; 55 breathing light;
511 front plate;

61 housing; 62 door body; 64 control panel; 65 breathing light; and

611 front plate.

DETAILED DESCRIPTION

Embodiments of the present disclosure are described below in detail with reference to the drawings. Apparently, the described embodiments are merely some embodiments of the present application, rather than all the embodiments. The present application provides a washing machine including a breathing light group, a door body (22), a door hinge (26), a housing (21) and a computer program controller. The breathing light group is arranged on the door body, and includes at least one breathing light. The computer program controller is configured to control and change a quantity ratio of bright breathing lights to dimmed breathing lights among a plurality of breathing lights in the breathing light group according to a change of a working progress of the washing machine. When the washing machine is used, a user can easily and roughly deduce a real-time operation state of the washing machine according to the quantity ratio of bright breathing lights to dimmed breathing lights in the breathing light group even if the user is too far away from the washing machine to see the contents displayed on a display screen clearly. Meanwhile, the user can observe a procedure operation progress of the washing machine, for example, a time left until the procedure is ended, thereby improving user experience and also enhancing aesthetic effect.

The door body is connected to the housing via the door hinge. The door hinge has a passage for accommodating a wire harness of the breathing light group; and the wire harness penetrates through the housing through the passage and is connected to the computer program controller. By arranging the passage through which the wire harness of the breathing light group penetrates on the door hinge, the wire harness may be hidden in the door hinge. Thus, on one hand, the wire harness is effectively fixed, and is protected; and on the other hand, the user will not see the wire harness from outside, so that the washing machine has a nice appearance.

In the present application, as an alternative embodiment, the change of the working progress is a change of a ratio of the time during which a selected procedure is ran or the remaining time to a total operation time of the selected procedure.

For example, before the selected procedure is activated, all the breathing lights dim or are turned off. With the change of the working progress, the number of dimmed or turned-off breathing lights is reduced gradually, the number of lighted breathing lights is increased gradually, and all the breathing lights are in a lighted state until the entire working procedure is completed. Optionally, before the washing machine starts to work, all the breathing lights are lighted up. With the change of the working progress, the number of lighted breathing lights is reduced gradually, the number of dimmed or turned-off breathing lights is increased gradually, and all the breathing lights are in a dimmed or turned-off state until the entire working procedure is completed.

The working procedure depends on a choice of the user. A washing process, a rinsing process and a drying process can constitute the entire working procedure. A separated washing process, rinsing process or drying process may also be called as a working procedure.

In the case that the washing process, the rinsing process and the drying process are used as one working procedure, it is assumed that the time required for the entire working procedure is 30 min, the time required for the washing process is 15 min, the time required for the rinsing process is 10 min, and the time required for the drying process is 5 min. Before a selected procedure is activated, all the breathing lights dim or are turned off. When the washing process is ended, the lighted breathing lights account for one half of the breathing lights in the entire breathing light group. When the rinsing process is ended, the lighted breathing lights account for five sixths of the breathing lights in the entire breathing light group. When the drying process is ended, all the breathing lights are in the lighted state, which indicates that the entire working procedure is completed.

The washing machine is described below by several embodiments.

Embodiment I

Figure 2:
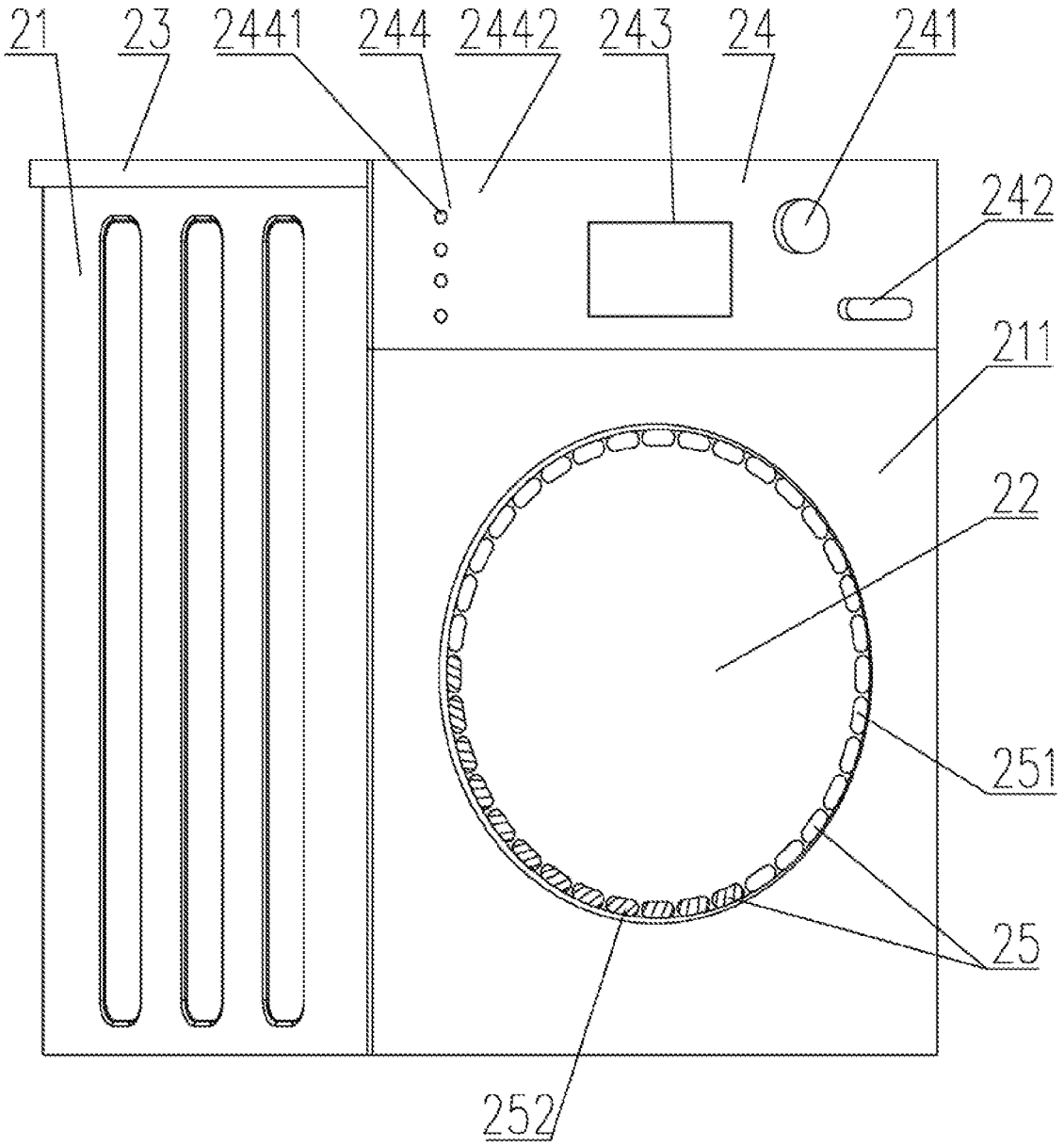
FIG. 2 illustrates a light-emitting state of breathing lights when a washing procedure has been carried out for a quarter of a total time provided by embodiment I of the present disclosure.
Figure 3:
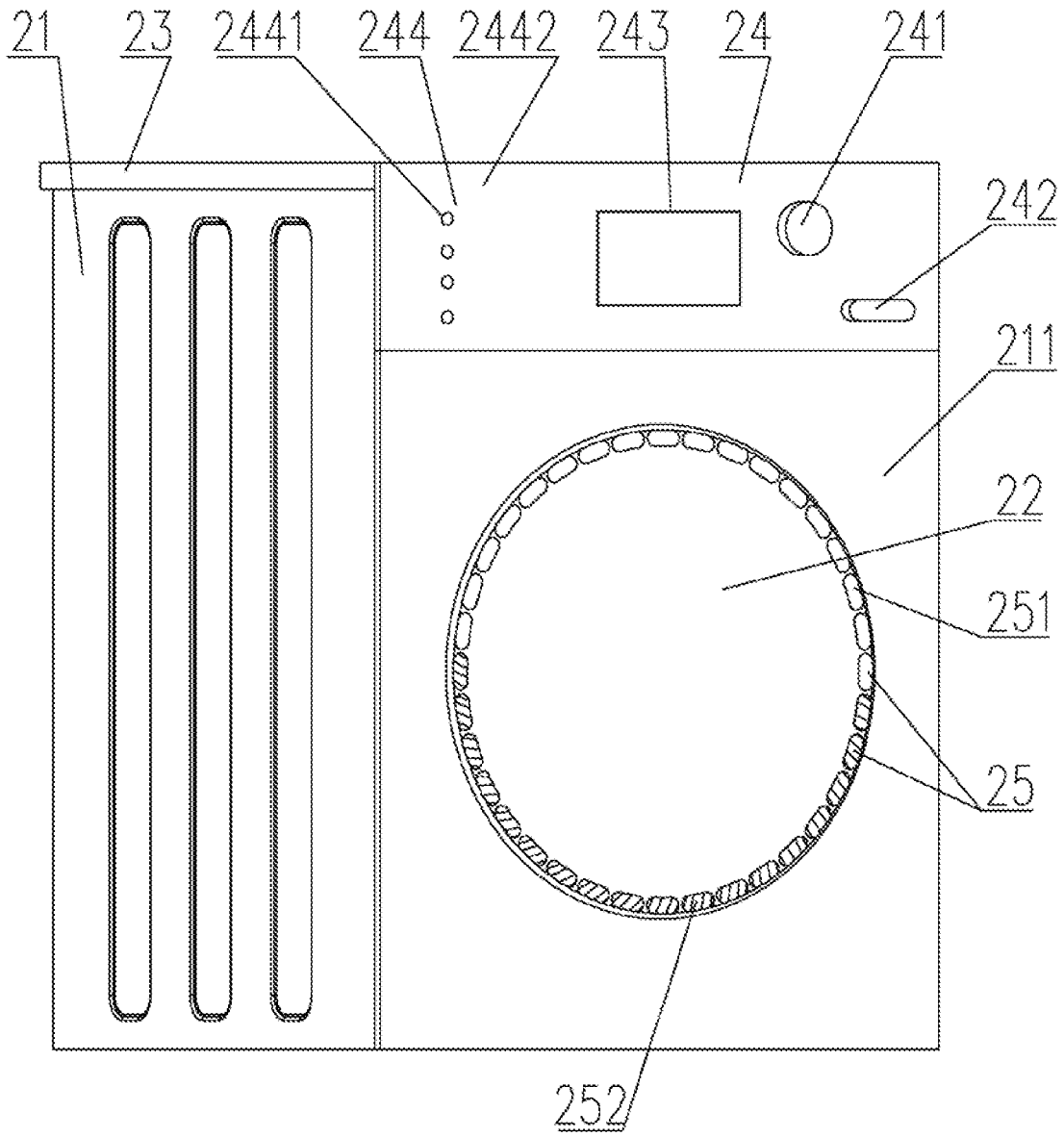
FIG. 3 illustrates a light-emitting state of breathing lights when a washing procedure has been carried out for half of a total time provided by embodiment I of the present disclosure.

As shown in FIG. 2 to FIG. 3, the washing machine provided by the present disclosure includes a housing 21, a door body 22, an upper cover plate 23 and a control panel 24. The upper cover plate 23 is arranged at an upper end of the housing 21. A front end of the housing 21 is a front plate 211. The door body 22 is arranged on the front plate 211 of the housing 21. The door body 22 is a circular door body. The control panel 24 is arranged at a front end of the housing 21 and is located above the front plate 211.

The control panel 24 is provided with a function selection knob 241, a power button 242 and an operating state display region 244. In the present embodiment, as an alternative implement, the operating state display region 244 is composed of indicator lights 2441 and a text description sub-region 2442 corresponding to the indicator lights 2441. That is, each indicator light corresponds to a text description.

Besides the above structure, a breathing light group is further arranged on the washing machine. The breathing light group is annular. The annular breathing light group is arranged on a perimeter of the internal side of the door body 22. The breathing light group is formed by arranging a plurality of breathing lights 25 according to certain rules sequentially and uniformly. Each of the breathing lights 25 is connected to a computer program controller. The computer program controller may be used to control the breathing lights 25 to be turned on/turned off.

Alternatively, after the washing machine is powered on, the annular breathing light group on the perimeter of the internal side of the door body 22 may dim, but not extinguished. When a certain washing procedure of the washing machine is selected and started, the annular breathing light group on the perimeter of the internal side of the door body 22 will be lighted up gradually from a certain position on the perimeter of the internal side of the door body 22 as the washing procedure proceeds, until the annular breathing light group keeps a maximum brightness. For example, FIG. 2 illustrates a light-emitting state of the breathing light group when the washing procedure has been carried out for a quarter of a total time. As shown in FIG. 2, a dark region 251 accounts for three quarters of the length of the entire breathing light group, and a lighted region 252 accounts for one quarter of the length of the entire breathing light group, indicating that one quarter of the washing procedure has been carried out, three quarters of the washing procedure has not been carried out yet. In this way, the user can calculate the time required to complete the washing procedure according to the total time used for completing the procedure. FIG. 3 illustrates the light-emitting state of the breathing light group when the washing procedure has been carried out for a half of the total time. As shown in FIG. 3, the dark region 251 accounts for one half of the length of the entire breathing light group, and the lighted region 252 accounts for one half of the length of the entire breathing light group, indicating that one half of the washing procedure has been carried out, and one half of the washing procedure has not been carried out yet. In this way, the user can roughly deduce a remaining washing time of the washing machine according to the light-emitting state of the breathing group even if the user is too far away from the washing machine to see the contents displayed on the display screen clearly.

In the present embodiment, the breathing lights 25 are arranged in two ways. As a first alternative, a light guide body is arranged between every two adjacent breathing lights 25. The light guide body has two ends which are in contact with the breathing lights 25 respectively, and is capable of transmitting light emitted by the breathing lights 25, thereby reducing the number of the breathing lights 25 required for forming a breathing light group with the same length, and saving the breathing lights 25. Since the number of the breathing lights 25 is reduced, a control process of the computer program controller is simpler.

Figure 4:
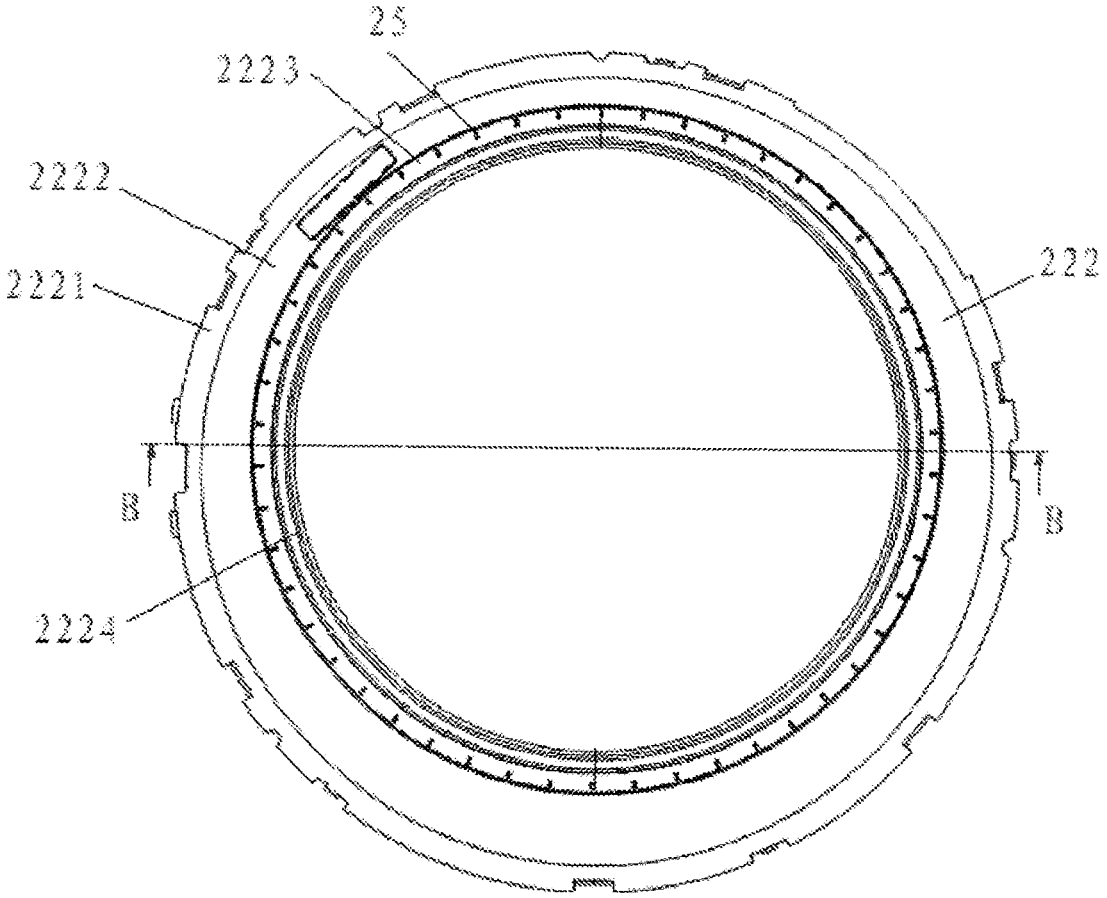
FIG. 4 is a schematic diagram illustrating a structure provided by embodiment I of the present disclosure in which breathing lights are mounted on a middle frame.
Figure 5:
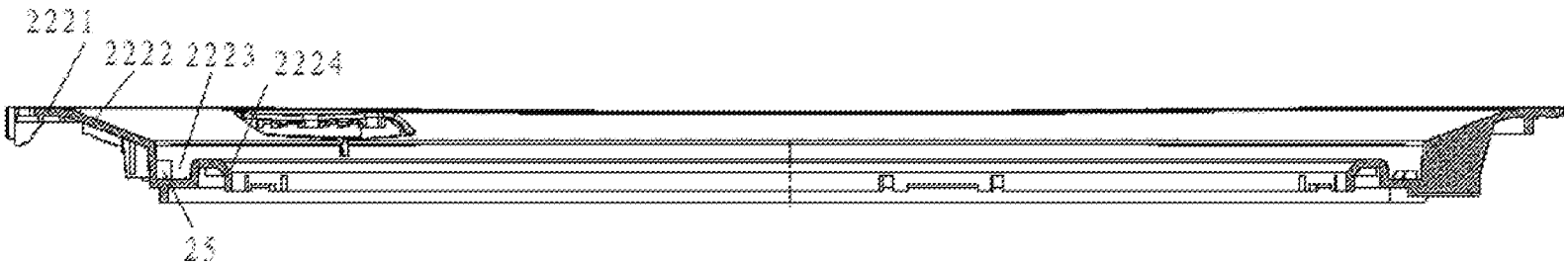
FIG. 5 is a sectional view along B-B line in FIG. 4.

As a second alternative, the door body 22 includes an outer frame, a middle frame and a glass window. An outer edge of the glass window is arranged between the outer frame and the middle frame to fix the glass window. As shown in FIG. 4 and FIG. 5, the middle frame 222 includes an outer annular surface 2221, a middle annular surface 2222, an annular groove 2223 and a mounting portion 2224 for fixing the glass window sequentially arranged from an outer periphery to a center position. The outer annular surface 2221 is a vertical surface. The middle annular surface 2222 is arranged obliquely relative to the outer annular surface 2221. One side of the middle annular surface 2222 close to the annular groove 2223 is inclined to a direction of the outer frame. The annular groove 2223 is recessed towards the outer frame. The breathing lights 25 are arranged on a side wall of the annular groove 2223 close to the middle annular surface 2222. A light exiting direction of the breathing lights points to a center of the door body 22. In the present embodiment, the breathing lights 25 are LED light beads. 80 LED light beads are uniformly arranged on the side wall of the annular groove 2223 along a circumferential direction, to produce a halo effect by refraction and reflection of the obliquely arranged middle annular surface 2222 and the vertically arranged outer annular surface 2221 without arranging the light guide body. In addition, the middle annular surface 2222 can be arranged as an arc surface protruded inward, and an inclination angle and a radian of the middle annular surface 2222 are determined by a scope of exiting angles of the breathing lights 25.

Alternatively, in order to remind the remaining time accurately, in the present embodiment, as an alternative manner, a remaining time display region 243 for displaying the remaining time of the washing procedure is also arranged on the control panel 24.

Figure 6:
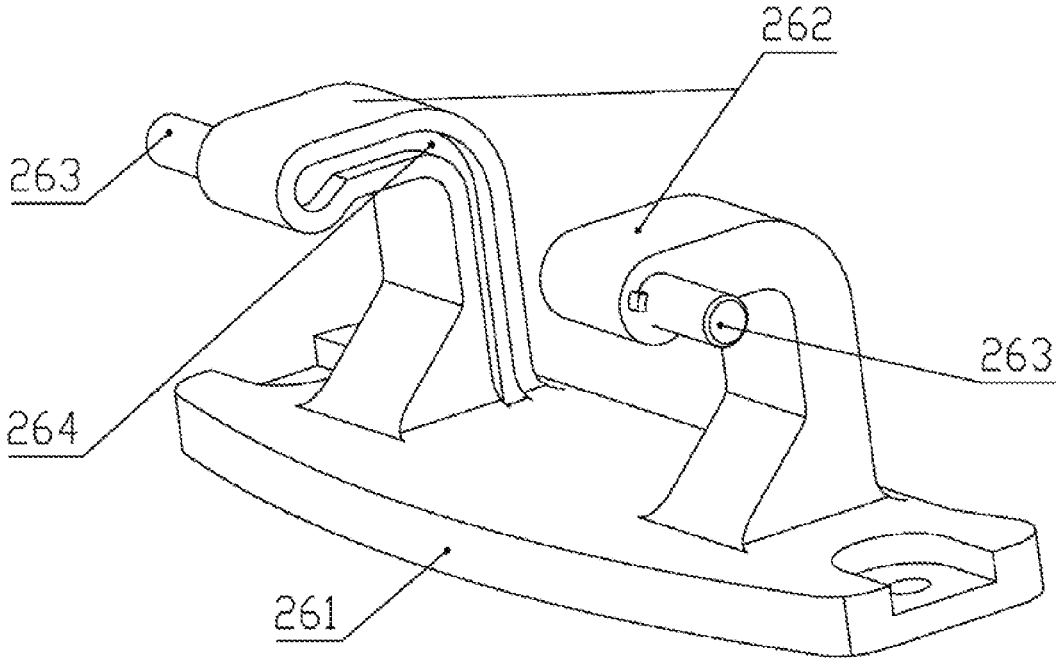
FIG. 6 is a structural schematic diagram illustrating a door hinge provided by embodiment I of the present disclosure.
Figure 7:
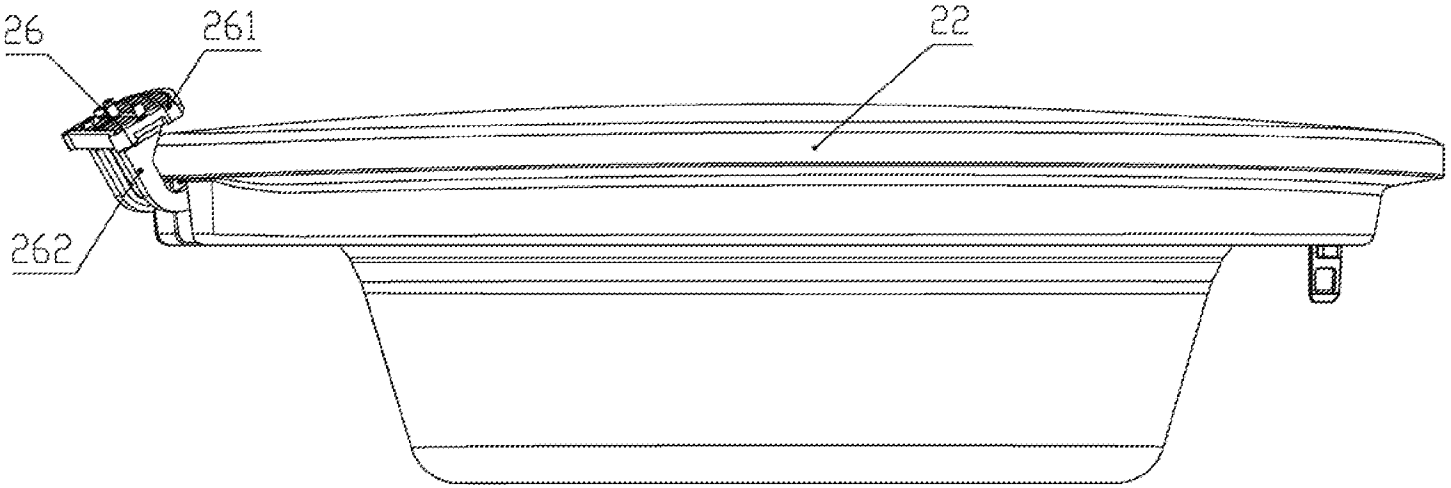
FIG. 7 is a schematic diagram illustrating matching of a refrigerator door body and a door hinge provided by embodiment I of the present disclosure.

As shown in FIG. 7, the door body 22 is connected to the housing 21 via a door hinge 26. As shown in FIG. 6, the door hinge 26 includes a hinge base 261, two supporting cantilevers 262 arranged on the hinge base 261, and rotating shafts 263 arranged at free ends of the supporting cantilevers 262. The hinge base 261 is fixed on the front plate 211 of the housing 21. The door body 22 is rotatably arranged on the rotating shafts 263. A side face of the supporting cantilever 262 close to the adjacent supporting cantilever 262 is formed with a groove 264. The groove 264 is extended to the hinge base 261 from a free end of the supporting cantilever 262. A through hole is formed in the hinge base 261 at a position corresponding to the groove 264. The groove 264 is communicated with the through hole so as to form the passage for accommodating the wire harness. The wire harness of the breathing light group arranged on the perimeter of the internal side of the door body 22 enters the passage through the door body 22, penetrates through the passage and the front plate 211 of the housing 21 to enter the washing machine, so as to be connected to the computer program controller.

As an alternative mode, a sealing cover is detachably arranged at a notch of the groove 264. The notch of the groove 264 can be closed by the sealing cover to prevent the wire harness from bending when opening and closing the door, thereby protecting the wire harness. The sealing cover may be made of rubber, plastics and other materials. The sealing cover and the notch of the groove 264 may be matched with each other through clamping, plugging and the like, but is not limited to this as long as the sealing cover is disassembled easily.

Optionally, the wire harness may be adhered to an inner wall of the groove 264 by metal adhesive to be fixed.

The passage for accommodating the wire harness is not limited to the groove 264 formed in the supporting cantilever 262, and may also be arranged inside the supporting cantilever 262. Thus, the wire harness is ensured to be free from bending when opening and closing the door even if no sealing cover is arranged. The groove 264 is not limited to be formed in the side face of the supporting cantilever 262 close to adjacent supporting cantilever 262, and may also be formed in other side faces of the supporting cantilever 262. The number of the grooves 264 is not limited to one, and may be set according to the number of wire harnesses.

Embodiment II

Figure 8:
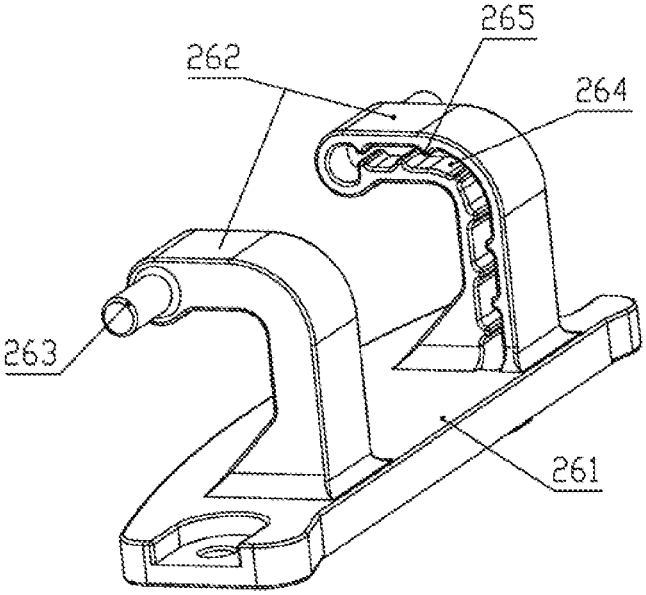
FIG. 8 is a perspective diagram illustrating a door hinge provided by embodiment II of the present disclosure.
Figure 9:
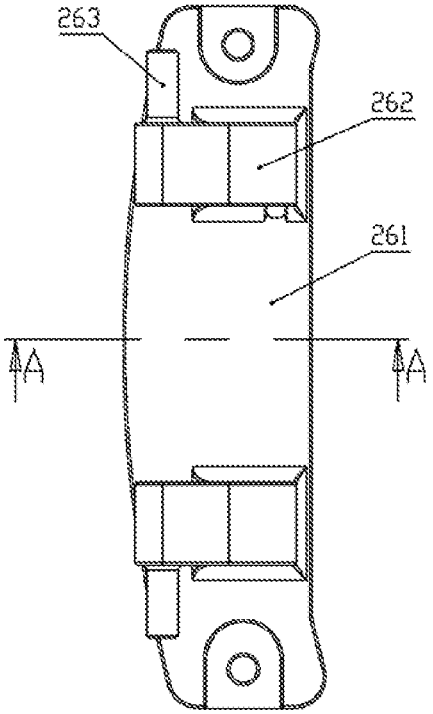
FIG. 9 is a top view illustrating a door hinge provided by embodiment II of the present disclosure.
Figure 10:
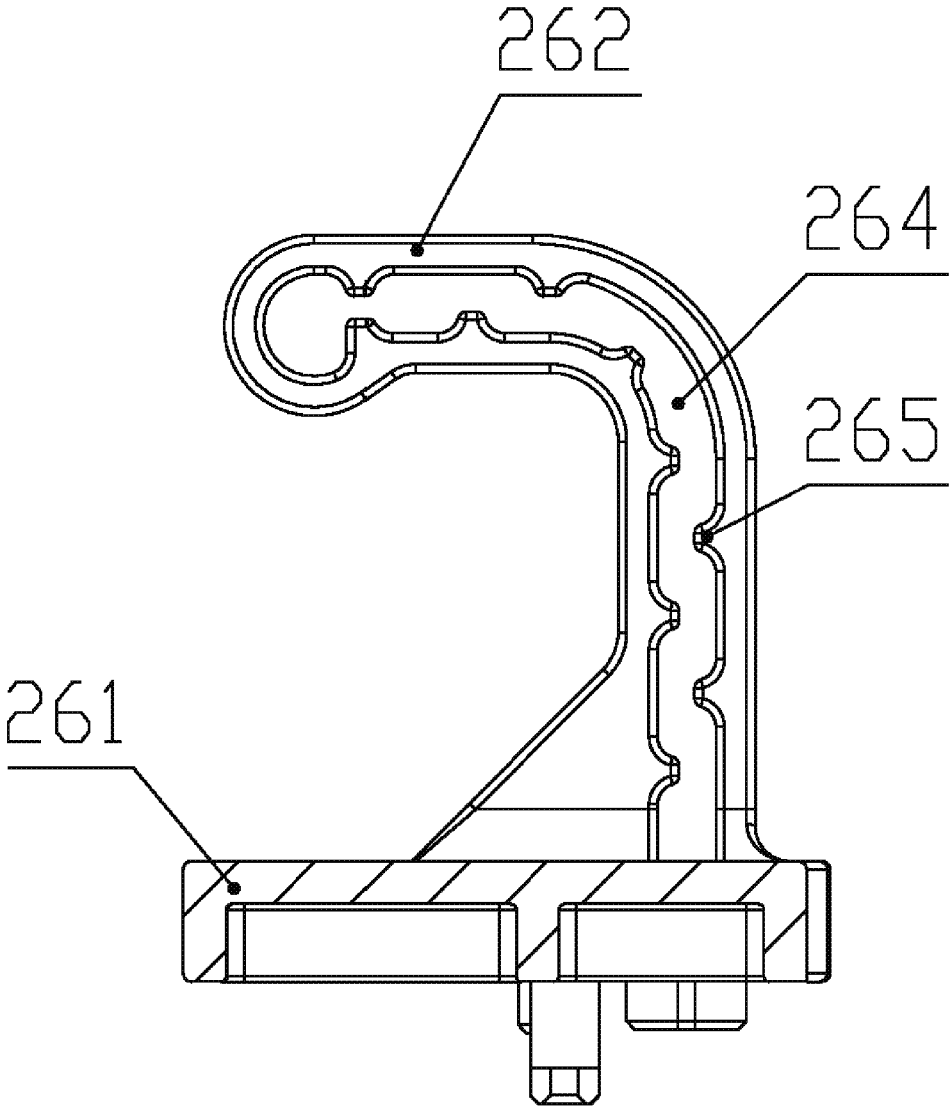
FIG. 10 is a sectional view along A-A line in FIG. 7.

The present embodiment provides a washing machine having a structure the same as that of embodiment I. Specifically, the door body 22 is connected to the housing 21 via a door hinge 26. As shown in FIG. 8 to FIG. 10, the door hinge 26 includes a hinge base 261, two supporting cantilevers 262 arranged on the hinge base 261, and rotating shafts 263 arranged on the free ends of the supporting cantilevers 262. The hinge base 261 is fixed to the front plate of the housing. The door body 22 is rotatably arranged on the rotating shafts 263. The supporting cantilever 262 is formed with a groove 264 in the side face close to the adjacent supporting cantilever 262. The groove 264 is extended to the hinge base 261 from the free end of the supporting cantilever 262. A through hole is formed in the hinge base 261 at a position corresponding to the groove 264. The groove 264 is communicated with the through hole so as to form the passage for accommodating the wire harness. The wire harness of the breathing light group arranged on the perimeter of the internal side of the door body enters the passage through the door body, penetrates through the passage and the front plate of the housing to enter the washing machine, so as to be connected to the computer program controller.

A difference between embodiment I and embodiment II lies in that a wire harness fixing structure is further arranged in the groove 264 in the present embodiment. The wire harness of the breathing light group is fixed in the groove 264 via the wire harness fixing structure. In the present embodiment, the wire harness fixing structure includes a plurality of ribs 265 arranged on two opposite side walls of the groove 264 in a protruding manner. The wire harness of the breathing light group is clamped between the ribs 265 on both sides to be fixed.

As an alternative mode, the ribs 265 on the two opposite side walls are arranged in a staggered manner to improve a fixing effect on the wire harness.

Embodiment III

In embodiment I and embodiment II, the breathing lights are arranged on the perimeter of the door body. However, the position of the breathing light group is not limited to that described in embodiment I and embodiment II. The breathing lights may also be arranged in other portions of the washing machine.

Figure 11:
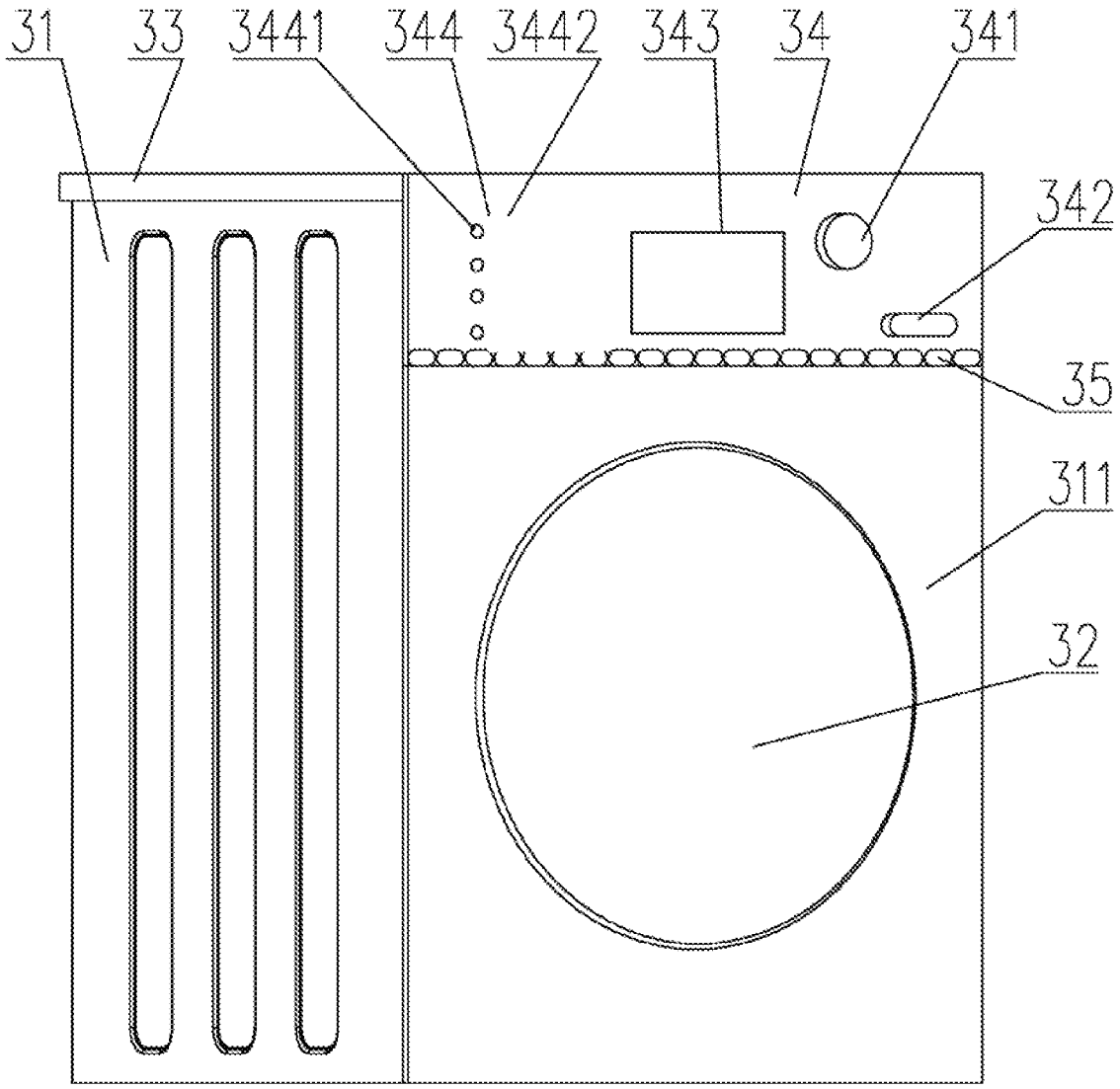
FIG. 11 is a structural schematic diagram illustrating a washing machine provided by embodiment III of the present disclosure in which a breathing light group is located at a lower edge of a control panel.

In the present embodiment, as shown in FIG. 11, a door body 32 is arranged at a center position of a front plate 311 of a housing 31. A control panel 34 is arranged at a front end of the housing 31, and is located above the front plate 311. In the present embodiment, the washing machine is also provided with the breathing light group. However, different from embodiment I and embodiment II, in the present embodiment, the breathing light group is a strip-shaped breathing light group formed by a plurality of breathing lights 35. The linear breathing light group is arranged at a lower edge of the control panel 34.

Similarly to embodiment I, the door body 32 in the present embodiment is connected to the housing 31 via the door hinge. The door hinge has the passage for accommodating the wire harness of the breathing light group. The wire harness penetrates through the housing 31 through the passage and is connected to the computer program controller.

Embodiment IV

Figure 12:
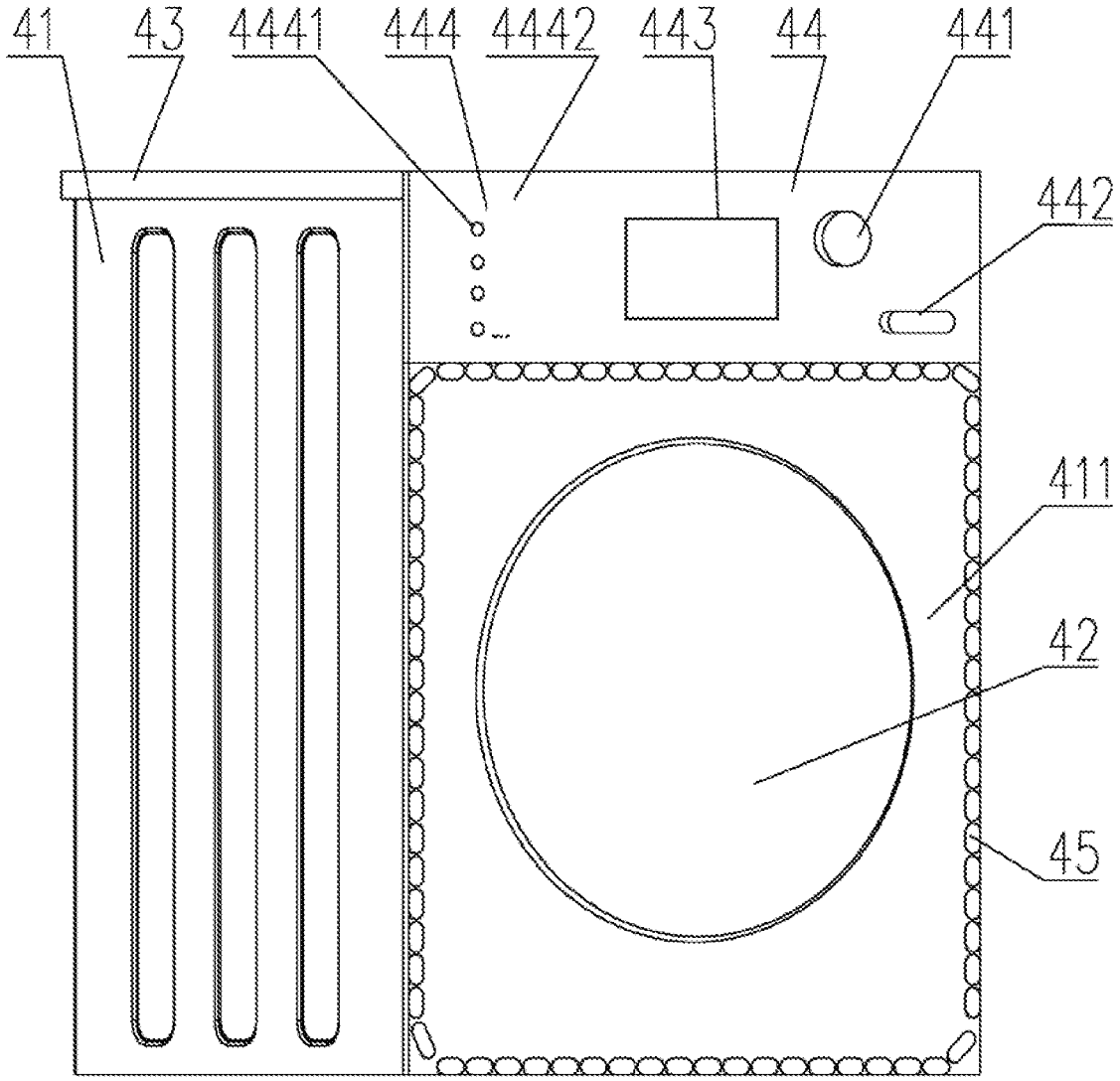
FIG. 12 is a structural schematic diagram illustrating a washing machine provided by embodiment IV of the present disclosure in which a breathing light group is located at a perimeter of a front plate of a housing.

In the present embodiment, as shown in FIG. 12, a door body 42 is arranged at a center position of a front plate 411 of a housing 41. A control panel 44 is arranged at a front end of the housing 41, and is located above the front plate 411. In the present embodiment, the washing machine is also provided with the breathing light group. Different from embodiments I~III, in the present embodiment, the breathing light group is a rectangular breathing light group formed by a plurality of breathing lights 45. The rectangular breathing light group is arranged at the perimeter of the front plate 411 of the housing 41.

Similarly to embodiment I, the door body 42 in the present embodiment is connected to the housing 41 via the door hinge. The door hinge has the passage for accommodating the wire harness of the breathing light group. The wire harness penetrates through the housing 41 through the passage and is connected to the computer program controller.

Embodiment V

Figure 13:
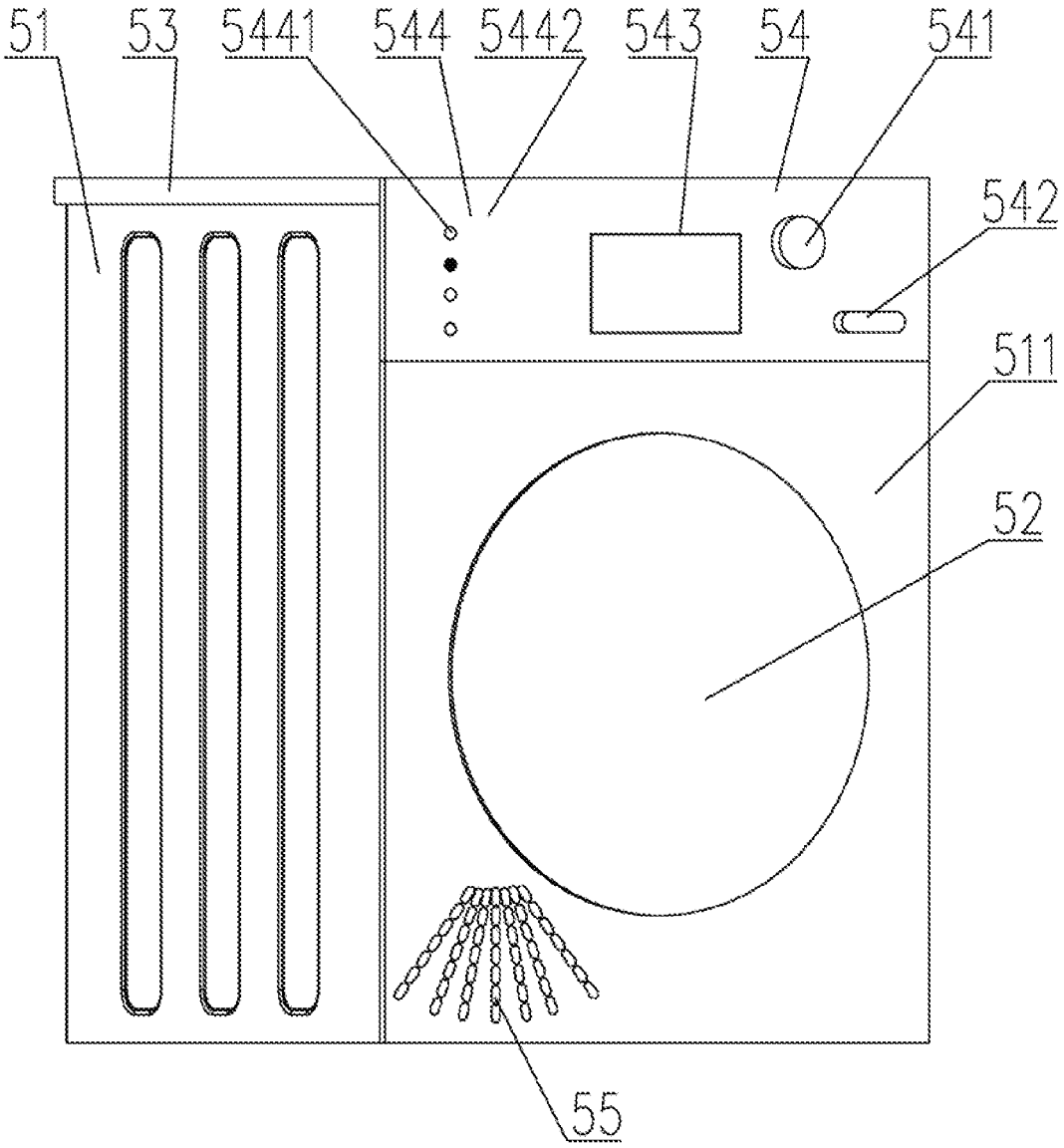
FIG. 13 is a structural schematic diagram illustrating a washing machine provided by embodiment V of the present disclosure in which a breathing light group is in a shape of a sector.

In the present embodiment, as shown in FIG. 13, a door body 52 is arranged in a center position of a front plate 511 of a housing 51. A control panel 54 is arranged at a front end of the housing 51, and is located above the front plate 511. In the present embodiment, the washing machine is also provided with the breathing light group. Different from embodiments I~IV, in the present embodiment, the breathing light group is a sector-shaped breathing light group formed by a plurality of breathing lights 55. The sector-shaped breathing light group is arranged in a bottom left corner of the front plate 511 of the housing 51.

Similarly to embodiment I, the door body 52 in the present embodiment is connected to the housing 51 via the door hinge. The door hinge has the passage for accommodating the wire harness of the breathing light group. The wire harness penetrates through the housing 51 through the passage and is connected to the computer program controller.

Embodiment VI

Figure 14:
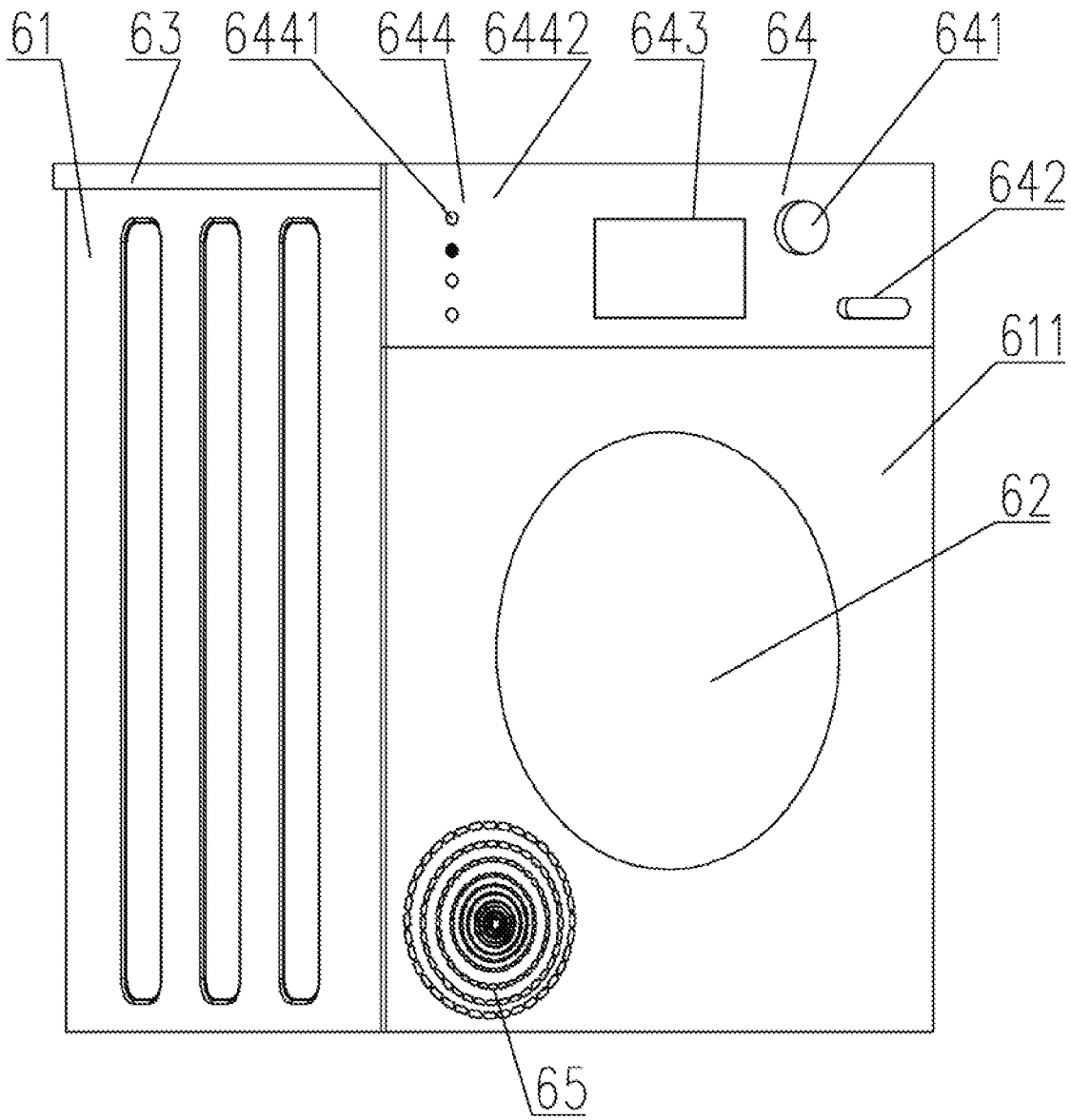
FIG. 14 is a structural schematic diagram illustrating a washing machine provided by embodiment VI of the present disclosure in which a breathing light group is circular.

In the present embodiment, as shown in FIG. 14, a door body 62 is arranged in a center position of a front plate 611 of a housing 61. A control panel 64 is arranged at a front end of the housing 61, and is located above the front plate 611. In the present embodiment, the washing machine is also provided with the breathing light group. Different from embodiments I~V, in the present embodiment, the breathing light group is circular and is formed by a plurality of circular ring-shaped sub-breathing light groups. The plurality of circular ring-shaped sub-breathing light groups are different in diameters, and are arranged from the inside to the outside. All the circular ring-shaped sub-breathing light groups are concentric. Each of the circular ring-shaped sub-breathing light groups is formed by a plurality of breathing lights 65 sequentially connected. The circular breathing light groups are arranged in the bottom left corner of the front plate 611 of the housing 61. The breathing light groups may also be elliptical, and is formed by a plurality of elliptical ring-shaped sub-breathing light groups arranged from the inside to the outside.

Optionally, the shapes of the breathing lights are not limited to the above five modes, and may also be other shapes. The positions of the breathing lights on the outer wall of the washing machine are also not limited to positions in the above five embodiments. The user can roughly deduce the remaining washing time of the washing machine according to a quantity ratio of bright breathing lights to dimmed breathing lights among the breathing lights in the breathing light group, bright and dark conditions of the breathing lights in the breathing light group at the start or the end of the washing procedure, and a total operation time of the washing procedure. The structures and the positions of the breathing lights belong to a protection scope of the present application.

Similarly to embodiment I, the door body 62 in the present embodiment is connected to the housing 61 via the door hinge. The door hinge has the passage for accommodating the wire harness of the breathing light group. The wire harness penetrates through the housing 61 through the passage and is connected to the computer program controller.

The present application further provides a method for controlling the washing machine. The method is applied to the washing machine provided by any one of the above apparatus embodiments. The method for controlling the washing machine includes step S1.

In S1, a computer program controller changes a quantity ratio of bright breathing lights to dimmed breathing lights in a breathing light group, so as to distinctively display different operating states of the washing machine.

The implementation method is introduced below through two embodiments.

Embodiment VII

In the present embodiment, step S1 includes steps described below.

In S111, the computer program controller is configured to calculate the number n of the breathing lights being lighted when the working progress proceeds to a ΔT stage based on the following formula:

$$n=\Delta T*N/T0,$$

where T0 indicates a total operation time of a selected procedure; ΔT indicates a time that the selected procedure has been operated; N indicates a total number of the breathing lights.

In S112, after the working procedure is activated, the computer program controller is configured to control n breathing lights to be lighted up when the working progress proceeds to the ΔT stage.

Before the selected procedure is activated, all the breathing lights dim or are turned off. With the change of the working progress, the number of dimmed or turned-off breathing lights is reduced gradually, the number of lighted breathing lights is increased gradually, and all the breathing lights are in a lighted state until the working procedure is completed.

Optionally, in the case that the N breathing lights form an annular shape, after the working procedure is activated, the computer program controller is configured to control n adjacent breathing lights to be lighted up in a preset order before the working progress proceeds to the ΔT stage. At this time, the other N-n breathing lights dim or are turned off. The end of the working procedure can be deduced until all the breathing lights are lighted up and the breathing light group keeps the maximum brightness.

In the case that the washing process is one working procedure, assuming that the time required for the entire working procedure is 30 min, all the breathing lights dim or are turned off before the selected procedure is activated. The number of the lighted breathing lights accounts for one third of the number of the breathing lights in the entire breathing light group when the washing procedure has been carried out for 10 min. The number of the lighted breathing lights accounts for two thirds of the number of the breathing lights in the entire breathing light group when the washing procedure has been carried out for 20 min. All the breathing lights are in the lighted state when the washing procedure has been carried out for 30 min, which indicates that the entire working procedure is completed.

In the present embodiment, in step S112, the computer program controller is configured to control n breathing lights to be lighted up in a preset order before the working progress proceeds to the ΔT stage. At least one breathing light is lighted up every time, as long as n breathing lights are lighted up sequentially and uniformly before the working progress proceeds to the ΔT stage.

In the present embodiment, by taking the shapes and positions of the breathing lights disclosed in embodiments I, II or embodiment IV as an example, the breathing lights may be sequentially lighted up from one breathing light clockwise or counterclockwise. Or, the breathing lights may be sequentially lighted up from one breathing light along two different directions from both sides of the breathing light.

Taking the shape and position of the breathing lights disclosed in embodiment III as an example, the breathing lights may be sequentially lighted up from the first breathing light on the left to the right.

Taking the shape and position of the breathing lights disclosed in embodiment V as an example, the breathing lights may be sequentially lighted up clockwise or counterclockwise by starting with a column of breathing lights.

Taking the shape and position of the breathing lights disclosed in embodiment VI as an example, the breathing lights may be sequentially lighted up from the breathing lights in the innermost circle along a direction from the inside to the outside.

Embodiment VIII

In the present embodiment, step S1 includes steps described below.

In S121, the computer program controller is configured to calculate the number n of the dimmed or turned-off breathing lights when the working progress proceeds to a ΔT stage based on the following formula:

$$n=\Delta T*N/T0,$$

where T0 indicates a total operation time of a selected procedure; ΔT indicates a remaining time of the selected procedure; N indicates a total number of the breathing lights.

In S122, after the working procedure is activated, the computer program controller is configured to control n breathing lights to dim or be turned off when the working progress proceeds to the ΔT stage.

Before the selected procedure is activated, all the breathing lights are lighted up. After the working procedure is started, with the change of the working progress, the number of the lighted breathing lights is reduced gradually, the number of the dimmed or turned-off breathing lights is increased gradually, and all the breathing lights are in a dimmed or turned-off state until the working procedure is completed.

In step S122, optionally, description is made by taking the situation that the N breathing lights form an annular shape as an example. After the working procedure is activated, the computer program controller is configured to control n adjacent breathing lights to be dimed or turned off in a preset order before the working progress proceeds to the ΔT stage. At this time, the other N-n breathing lights are lighted up. The end of the working procedure can be deduced until all the breathing lights dim or are turned off and the breathing light group keeps the minimum brightness.

In the present embodiment, in step S122, the computer program controller is configured to control n breathing lights to be dimed or turned off in a preset order before the working progress proceeds to the ΔT stage. At least one breathing light dims or be turned off every time, as long as n breathing lights dim or be turned off sequentially and uniformly before the working progress reaches the ΔT stage.

The order in which the breathing lights dim or are turned off is same as the order in which the breathing lights are lighted up in embodiment VII, and is not repeated herein.

Since the method for controlling the washing machine provided by the present disclosure is applied to the above washing machines, the control method includes the following step: S1, the computer program controller is controlled to change a quantity ratio of bright breathing lights to dimmed breathing lights in the breathing light group to distinctively display different working procedures of the washing machine. When the washing machine is used, the user can easily and roughly deduce a real-time operation state of the washing machine according to the quantity ratio of bright breathing lights to dimmed breathing lights in the breathing light group even if the user is too far away from the washing machine to see the contents displayed on the display screen clearly. Meanwhile, the user can observe a procedure operation progress of the washing machine, for example, a time left before the procedure is ended, thereby improving the user experience and also enhancing the aesthetic effect.

Meanwhile, during the operation of the washing machine, an operating state of the washing machine is shown flexibly by controlling a lighting length of the breathing lights. Besides a function of reminding the remaining washing time, the breathing lights are arranged on the washing machine to present a good visual decoration effect. Gradual change from bright to dark of the breathing light group likes breathing, can provide visual prompts, display good visual decoration effect, increase user experience effect, give the washing machine a nice, fashionable and highly intelligent appearance, improve flexibility and convenience in determining the washing state and the remaining washing time of the washing machine, and ensure vivid, natural and vital effects.

It should be noted that the above contents are only alternative embodiments and applied technical principles of the present application. Those skilled in the art can understand that the present application is not limited to the specific embodiments described herein. Those skilled in the art can make various apparent changes, readjustments and substitutions without departing from a protection scope of the present application. Thus, although the present application is described in detail by above embodiments, the present application is not limited to the above embodiments and can also include more other equivalent embodiments without departing from conception of the present disclosure. Moreover, the scope of the present application is determined by a scope of appended claims.

INDUSTRIAL APPLICABILITY

Embodiments of the present disclosure provide a washing machine. When the washing machine is used, a user can easily and roughly deduce a real-time operation state of the washing machine according to a quantity ratio of bright breathing lights to and dimmed breathing lights in a breathing light group even if the user is too far away from the washing machine to see the contents displayed on the display screen clearly. The wire harness is hidden in the door hinge. Therefore, on one hand, the wire harness is effectively fixed and protected, and on the other hand, the user will not see the wire harness from outside, so that the washing machine has a nice appearance.

What is claimed is:

1. A washing machine, comprising a light group, a door body, a door hinge, a housing and a computer program controller, wherein the light group is arranged on the door body, and comprises a plurality of breathing lights;

wherein the computer program controller is configured to change a quantity ratio of bright breathing lights to dimmed breathing lights among the plurality of breathing lights in the light group according to a change of a working progress of the washing machine; and the door body is connected to the housing via the door hinge, wherein the door hinge is provided with a passage for accommodating a wire harness of the light group, and the wire harness penetrates through the housing via the passage and is connected to the computer program controller of the washing machine;

wherein the door body comprises an outer frame, a middle frame and a glass window; an outer edge of the glass window is arranged between the outer frame and the middle frame to fix the glass window; the middle frame has an outer annular surface, a middle annular surface, an annular groove and a mounting portion for fixing the glass window sequentially arranged from an outer periphery to a center position, wherein the middle annular surface is arranged obliquely relative to the outer annular surface, and one side of the middle annular surface close to the annular groove is inclined towards the outer frame;

the plurality of breathing lights are arranged on a side wall of the annular groove close to the middle annular surface; and the middle annular surface is an arc surface protruded inward.

2. The washing machine according to claim 1, wherein the door hinge comprises a hinge base, a supporting cantilever arranged on the hinge base and a rotating shaft arranged at a free end of the supporting cantilever;

wherein the passage is provided on the supporting cantilever and penetrates through the hinge base.

3. The washing machine according to claim 2, wherein the passage comprises a groove formed in at least one side face of the supporting cantilever and a through hole formed in the hinge base, and the groove is extended from a free end of the supporting cantilever to the hinge base and is communicated with the through hole.

4. The washing machine according to claim 3, wherein a wire harness fixing structure is arranged in the groove.

5. The washing machine according to claim 4, wherein the wire harness fixing structure comprises a plurality of ribs arranged on two opposite side walls of the groove in a protruding manner, wherein the plurality of ribs are arranged in a staggered manner.

6. The washing machine according to claim 3, wherein a sealing cover is detachably arranged at a notch of the groove to close the notch of the groove.

7. The washing machine according to claim 6, wherein the wire harness is fixed to an inner wall of the groove via metal adhesive.

8. The washing machine according to claim 1, wherein a light guide body is arranged between two adjacent breathing lights of the plurality of breathing lights.

9. The washing machine according to claim 1, wherein the change of the working progress is a change of one of the followings: a ratio of the time during which a selected procedure has been operated to a total operation time of the selected procedure; and a ratio of a remaining time of the selected procedure to a total operation time of the selected procedure.

10. The washing machine according to claim 1, wherein the light group is further arranged on at least one of the following parts of the washing machine: a perimeter of an internal side of the door body; a control panel; and a front plate of the housing.

11. The washing machine according to claim 1, wherein the breathing lights in the light group are arranged in a shape selected from a group of a ring, a strip, a rectangle, a sector, an oval and a circle.

12. The washing machine according to claim 3, wherein the wire harness is fixed to an inner wall of the groove via metal adhesive.

13. A method for controlling a washing machine, wherein the washing machine comprises a light group, a door body, a door hinge, a housing and a computer program controller, wherein the light group is arranged on the door body, and comprises a plurality of breathing lights;

wherein the computer program controller is configured to change a quantity ratio of bright breathing lights to dimmed breathing lights among the plurality of breathing lights in the light group according to a change of a working progress of the washing machine;

the door body is connected to the housing via the door hinge, wherein the door hinge is provided with a passage for accommodating a wire harness of the light group, and the wire harness penetrates through the housing via the passage and is connected to the computer program controller of the washing machine; the door body comprises an outer frame, a middle frame and a glass window; an outer edge of the glass window is arranged between the outer frame and the middle frame to fix the glass window; the middle frame has an outer annular surface, a middle annular surface, an annular groove and a mounting portion for fixing the glass window sequentially arranged from an outer periphery to a center position, wherein the middle annular surface is arranged obliquely relative to the outer annular surface, and one side of the middle annular surface close to the annular groove is inclined towards the outer frame; the plurality of breathing lights are arranged on a side wall of the annular groove close to the middle annular surface; and the middle annular surface is an arc surface protruded inward;

the method comprises:

changing, by the computer program controller, the quantity ratio of bright breathing lights to dimmed breathing lights in the light group, to distinctively display different working procedures of the washing machine.

* * * * *